US005110187A

United States Patent [19]

Heintzmann et al.

[11] Patent Number: 5,110,187

[45] Date of Patent: May 5, 1992

[54] APPARATUS FOR THE MINING OF MINERAL MATTER, ESPECIALLY COAL

[75] Inventors: Peter Heintzmann, Bochum; Karl-Heinz Berger, Herten; Peter Walbrodt, Hünxe, all of Fed. Rep. of Germany

[73] Assignee: Bochumer Eisenhutte Heintzmann GmbH & Co. KG, Bochum, Fed. Rep. of Germany

[21] Appl. No.: 666,399

[22] Filed: Mar. 7, 1991

[30] Foreign Application Priority Data

Feb. 6, 1991 [DE] Fed. Rep. of Germany ..... 4103545

[51] Int. Cl.[5] ..... E21D 23/14

[52] U.S. Cl. ..... 299/1.4; 299/32; 405/302

[58] Field of Search ..... 299/1, 30, 32; 405/302; 91/170 MP

[56] References Cited

U.S. PATENT DOCUMENTS 4,330,154 5/1982 Harris ..... 299/1
5,029,943 7/1991 Merriman ..... 299/1

FOREIGN PATENT DOCUMENTS 1085274 9/1967 United Kingdom ..... 299/1
1175705 12/1969 United Kingdom ..... 299/1
2232697 12/1990 United Kingdom ..... 299/1

*Primary Examiner*—David J. Bagnell
*Attorney, Agent, or Firm*—Herbert Dubno

[57] ABSTRACT

A mining apparatus of the type in which a mining machine excavates a mining face, especially a coal face in a subterranean mining application, and has a plurality of emitters of electromagnetic waves of different character diverging toward receivers on the individual walking props. The walking props are provided with a control unit which, in response to leading and trailing zones of the respective magnetic beams and/or an overlap region of the two beams, causes the advance of the walking prop as the mining machine travels past it to follow the excavation of the mining face.

18 Claims, 4 Drawing Sheets

APPARATUS FOR THE MINING OF MINERAL MATTER, ESPECIALLY COAL

FIELD OF THE INVENTION

Our present invention relates to an apparatus for the mining of mineral matter, especially in subterranean mines wherein the mineral matter is located in a seam particularly for coal mining, in which a mining face or front is progressively cut away by a mining machine (also referred to as a miner or getter) and which cooperates with a conveyor device carrying away the excavated mineral matter, and an array of walking props which can be advanced to follow the advance of the mining face and which can be erected to support the roof of the mine or lowered to allow the prop to advance.

More particularly, the invention relates to systems of the aforedescribed type provided with control means for enabling the advance of the array of individual walking props to follow the advance of the mining machine in the direction of advance of the mining face or front.

BACKGROUND OF THE INVENTION

In an earlier apparatus of this type, the control means generally was actuated by hand or included mechanical sensors on the walking props which responded to advance of the mining machine and/or the conveyor unit. Information for the advance of the walking props was obtained by, for example, the conveyor device to which the mining machine could also be attached, e.g. as a coal plow on the conveyor chian. It was also known to provide special sequence control which would automatically advance the walking props based upon a projection as to the actual advance of the mining face. With respect to the manually controlled systems, since the intervention of an operator was always necessary, there was a certain lack of precision in the advance of the walking props resulting from human intervention. The other systems were complex to construct and required expensive control equipment. A commonly assigned U.S. Pat. No. 4,900,091 is relevant to the advance of an array of walking props to follow the excavation of a mining face.

OBJECTS OF THE INVENTION

It is, therefore, the principal object of the present invention to provide an apparatus for the mining of mineral matter from a seam especially in a subterranean mine, especially a coal mine, whereby the advance of the walking props to follow the excavation of the mineral matter can be improved without the need for expensive controlled equipment and/or manual intervention.

Still another object of this invention is to provide a system which is capable of controlling the advance of array of walking props to follow the advance of the mining machine, whereby the walking props are controlled with great precision.

Still another object of this invention is to provide a walking prop control system in a mining apparatus of the type described which avoids drawbacks of earlier systems.

SUMMARY OF THE INVENTION

These objects are attained, in accordance with the invention, in an apparatus for the mining of a mineral face, especially for the mining of coal which comprises:

a mining machine displaceable back and forth along the face for mining mineral matter therefrom, thereby advancing the face;

a conveyor device positioned to receive mined mineral matter dislodged from the face by the mining machine for removing the mineral matter;

an array of walking props extending along the face and advanceable as the face is advanced, the mining machine being provided with two signal emitters trained toward the array and each emitting a diverging beam of electromagnetic radiation with at least one characteristic different from that of the other of the beams so that, with respect to travel of the mining machine, one of the beams exclusively forms a leading zone, the other of the beams exclusively forms a trailing zone, and the beams are superimposed in an overlapping region;

at least one signal receiver responsive to the electromagnetic radiation from both of the signal emitters on each of the walking props; and control means connected to the signal receivers of the walking props and responsive to the different characteristics of the beams for controlling advance of the walking props to enable the walking props to follow advance of the face.

According to the invention, therefore, the control system for the advance of the walking props to follow the advance of the mining machine includes at least two signal emitters on the mining machine which are capable of emitting electromagnetic waves each of which has a radiation characteristic having the configuration of a cone as seen in plan view and has a different character from the other, the radiation characteristics being superimposed to a central overlapping region preceded by a leading zone contributed only by the electromagnetic waves from one of the emitters and followed by a trailing zone contributed only by the electromagnetic waves of the other signal emitter.

The individual walking props forming the array, each have at least one signal receiver for the electromagnetic waves of both signal emitters, the received signals being fed to a signal processor or evaluator and the signal processor, in response to the signals of a different character from at least the leading zone and the trading zone controls the advance of the respective walking prop to follow the advance of the mining machine.

The electromagnetic waves which can be used in accordance with the invention, include all of the electromagnetic waves as to which the Maxwell equations apply as well as those to which the optical laws apply and which can have a defined radiation characteristic as described, i.e. to be bundled in a beam of defined shape. With electromagnetic waves observing optical laws, the bundling can be effected by optical means such as lenses, prisms and the like. Electromagnetic waves having longer wavelengths can be provided with the defined characteristic, i.e. the defined divergency from the emitter toward the receiver by corresponding antenna systems. The character of the waves which distinguishes the waves from the two emitters at the receiver can be any of the parameters of the electromagnetic waves can be detected by the signal processing unit and can be used for the commands necessary to control the walking props. Especially, the differences can be differences as to frequency, as to amplitude and, in the case of pulse modulation or pulsed modulation, the pulse frequency and the pulse duration.

The control means can have a computer integrated therein for correlating each position of the mining machine with the respective prop location or prop unit to be advanced and can respond to the leading and trailing zones travelling with the mining machine. The control unit can, of course, not only effect the actual displacement of the individual walking props in succession to following the mining advance, but can also provide outputs for other mining purposes. For example, in the case of the walking props, it may provide the signals for retraction of the prop from its roof supporting position, advance of the prop to follow the mining operation and reerection of the prop to a roof supporting position.

As has been noted, the signal processor can respond to the differences in the characteristic of the signals from the leading zone and the trailing zone. It can also respond to the overlapping region in which the signals from the two emitters are superimposed. For the system of the invention, it is important to have both a central overlapping region in which the signals are superimposed and a leading zone and a trailing zone since this permits identification at each receiver of the movement and the direction of movement of the mining machine, enables determination of the speed as desired, and can signal the degree to which the particular walking prop must be advanced.

The two signal emitters can be mounted at the same location of the mining machine. In a preferred embodiment of the invention, however, the two signal emitters are mounted in spaced apart relation in the direction of movement of the mining machine.

It has been found to provide a simple evaluation of signals in the signal processor when the overlapping region at the receiver as measured in the direction of movement of the mining machine has a width which corresponds approximately to the length of the mining machine.

It has already been suggested that the invention can operate with widely differing kinds of electromagnetic waves. It is preferred for the purpose of the invention that the signal emitter, the receiver and the signal processor be responsive to electromagnetic waves in the light wave region including the infrared portion of the electromagnetic spectrum. The different characteristics of the two waves which are detected can be differences in frequency and/or amplitude and/or pulsing.

Since in mining applications contamination or soiling of the signal emitters and the signal receivers must be presumed, reliability can be enhanced in accordance with the invention by providing both the mining machine and the walking props, or at least one of them, with water supply units for rinsing off the signal emitters and/or signal receivers, preferably as the mining machine travels along its path.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
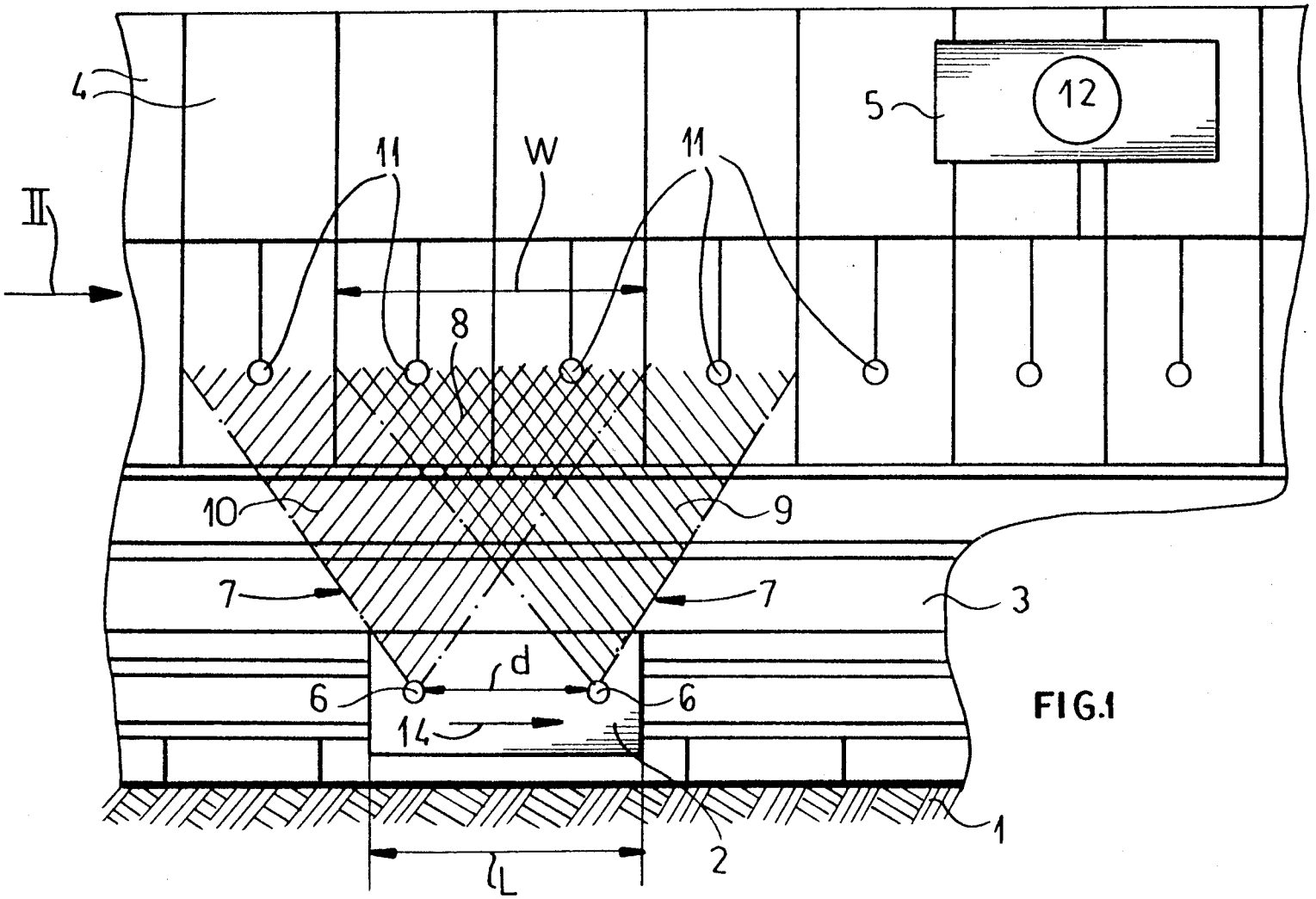
FIG. 1 is a diagrammatic plan view of a mining apparatus according to the invention.
Figure 2:
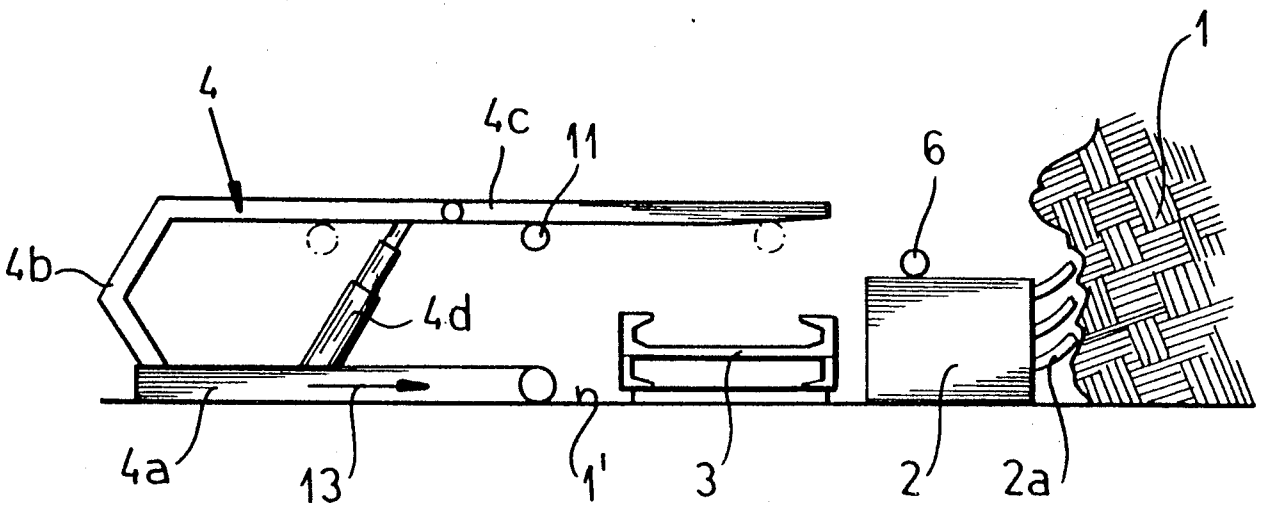
FIG. 2 is a view taken in the direction of the arrow II of FIG. 1, also in highly diagrammatic form.

As can be seen from FIGS. 1 and 2, an apparatus for the mining of mineral matter, especially coal, in a mine gallery, serves to remove the coal from the mining face or wall 1. The roof of the gallery has not been illustrated although the floor of the gallery can be seen at 1' in FIG. 2.

The apparatus comprises the mining machine 2 which is displaceable back and forth along the mining face 1 as is well known in the art and may be a plow-type mining machine whose excavators are represented at 2*a* and are designed to cast the excavational material into a conveyor unit shown diagrammatically at 3. The mining machine 2 may be coupled to the conveyor or formed as a plow on a chain which can also serve as the conveyor chain in a plow-type mining unit. The conveyor serves to carry away the mineral matter removed from the mining face 1.

An array of walking props 4 can be provided and can be advanced in the direction of the arrow 13 to follow advance of the mining machine 2 in the direction of the mining face and hence the advance of the mining face in the mining direction.

In addition, each walking prop 4 can be provided with a base 4*a* displaceable along the floor 1' of the gallery, a superstructure 4*b* on the base which can be pressed against the roof of the gallery and a shield 4*c* which can overhang the conveyor and the mining machine to protect the latter from falling debris. A hydraulic cylinder arrangement 4*d* can be extended or retracted to raise the prop to support the roof or withdraw the prop from engagement with the roof to allow advance of the prop in the direction of the arrow 13.

A control closet 5 of the apparatus may house the control unit 12 to which the receivers 11 can be connected. The controlled unit 12 serves for advancing the individual walking props in the direction of the mining face as the latter recedes in a sequential manner to define the mining action (see the aforementioned patent).

The mining machine 2 can have two signal emitters 6 which emit electromagnetic waves. As FIG. 1 illustrates diagrammatically, the signal emitters 6 each emit a beam with a diverging radiation characteristic 7, i.e. beam which is generally of conical outline. The different hatching of the two beams signifies that the electromagnetic waves emitted from the two signal emitters 6 each have different characteristics so that they can be identified as different beams. The radiation characteristics 7 are superimposed in a central overlapping region 8 with a width W which is approximately equal to the length L of the mining machine in the direction of travel of the latter represented by the arrow 14.

The beams also form a leading zone 9 and a trailing zone 10 such that the leading zone 9 and the trailing zone 10, by contrast with overlapping regions 8, are each formed by the beam from only one of the signal emitters, i.e. a beam having one of the characteristics 7 or the other.

Figure 4:
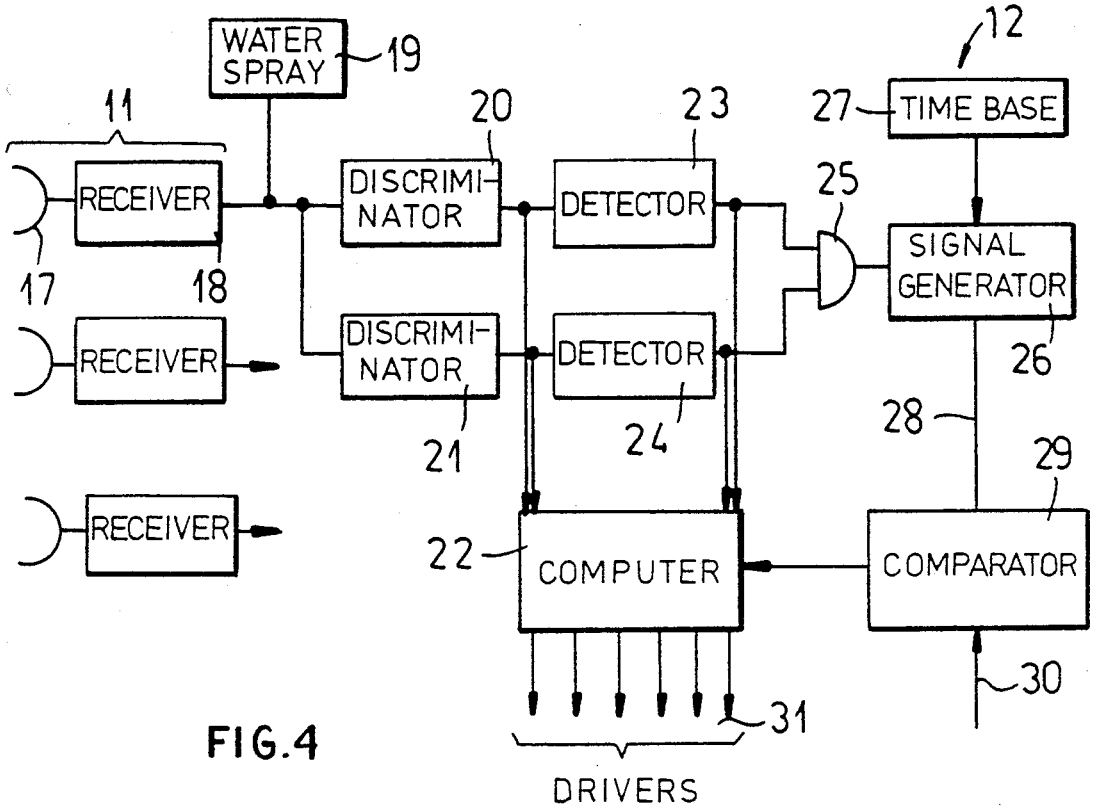
FIG. 4 is a block diagram illustrating parts of a control system according to the invention.

Each of the walking props 4 has at least one signal receiver 11 responsive to the electromagnetic waves of the two signal emitters. This receiver 11 can supply the received signals to the signal processor 12 which, distinguishing the signals from at least the leading zone 9 and the trailing zone 10, can effect the displacement of the walking props 4 to follow the excavation of the mining face. A computer for effecting this operation is incorporated in the signal processing circuitry 12 (FIG. 4).

The apparatus can be so constructed that the signal processor 12, based upon the distinctions between the signals from the leading zone 9 and the trailing zone 10 and the signals in the overlapping region 8 in which the waves from the two emitters are superimposed on one another, provides a measure of the requisite advance of the walking props.

Figure 3:
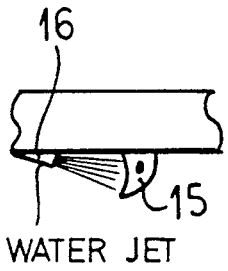
FIG. 3 is an elevational view illustrating a water jet used to clean a receiver or emitter.

In the embodiment illustrated and the preferred embodiment of the invention, the two signal emitters 6 are spaced apart by a distance d from one another. The electromagnetic waves which are used can be waves in the light wave portion of the electromagnetic spectrum. To that end, the emitter or receiver represented generically at 15 in FIG. 3 can be provided with a water jet 16 which directs a spray upon the emitter or receiver to wash contaminants therefrom. The water jet 16 can be triggered for the receivers 11 as the mining machine 2 travels into range.

For that purpose, the receivers 11 (FIG. 4) each of which has a sensor 17 picking up the electromagnetic wave and a transducer 18 for converting the electromagnetic signal into an electrical signal, may each be coupled to a valve 19 controlling the respective water spray.

The control system 12 can include, for example, discriminators 20 and 21 responsive to the particular pulse electromagnetic wave emitted from one although the other emitter and outputting signals to the computer 22 and, if desired, to detectors 23 and 24 operating an And gate 25 feeding a signal generator 26 which also receives a time base signal at 27.

In this manner, we are able to trigger the And gate into its conductive state only for the duration for which the superimposed region sweeps past the particular receiver 11. The output of the signal generator 26 is thus a signal 28 representing the duration of the overlapping region and is applied to a comparator 29 to which a setpoint signal is applied at 30. The setpoint signal represents a duration corresponding to a given distance of the receiver from the emitters and hence of the particular walking prop from the mining machine.

Should the comparator detect a difference, the computer 22 is triggered to operate respective drivers represented at 31 to advance the respective walking prop. The circuitry shown at 20 to 30 in FIG. 4 may be incorporated, if desired, in the computer 22.

Figure 6A:
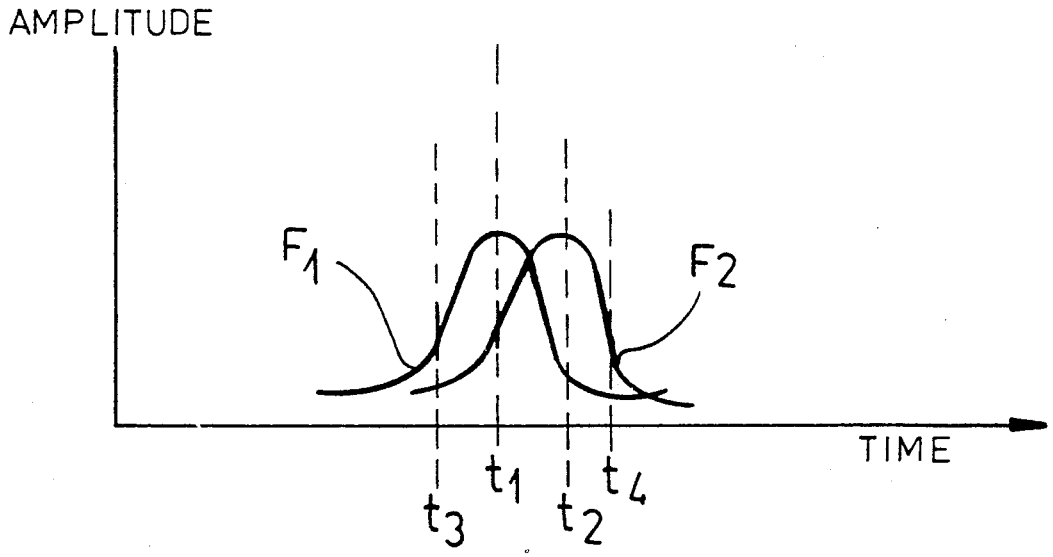
FIGS. 6*a* and 6*b* are graphs illustrating the operation of the system of the invention.
Figure 6B:
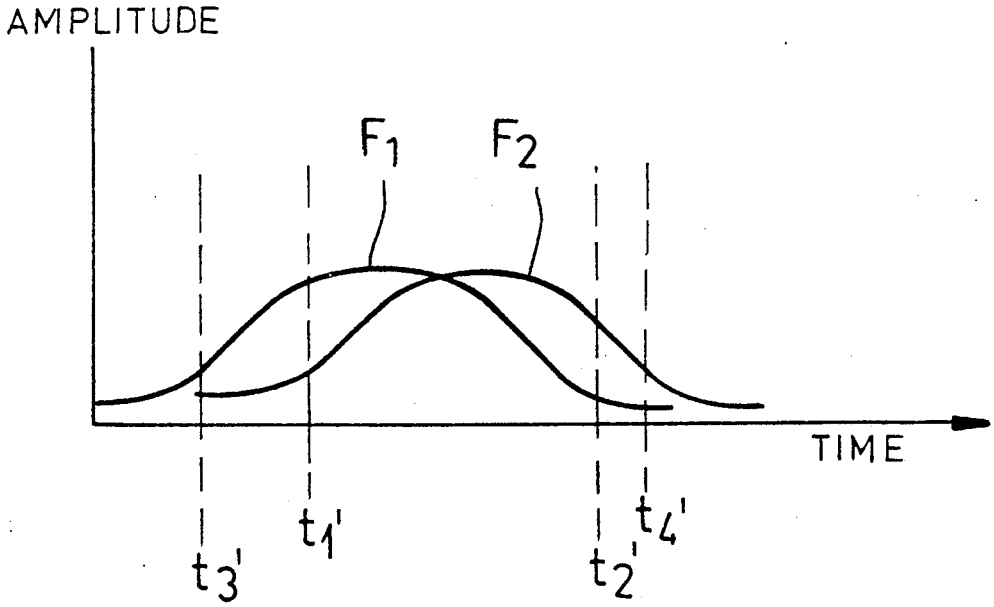

Referring to FIG. 6*a* which represents a reference state and in which amplitudes of the two beams $F_1$ and $F_2$ of different frequency has been plotted against time for the two waves from the emitters 6 as received at a receiver 11 for the reference state, it can be seen that times $t_1$ and $t_2$represent the overlapping region with respect to a certain threshold while times $t_3$ and $t_4$ represent the leading and trailing signals, also with respect to a threshold of amplitude. The traversal time $(t_4-t_3)$ or the overlap time $(t_2-t_1)$ for a mining machine moving at a constant speed will remain constant for a given distance of the sensor 11 from the path of the emitters 6. As the mining face is excavated, however, and the mining machine 2 moves away from the array of travelling props, the distance between the receiver 11 and the path of the emitters 6 increases. As a consequence, the time $(t_{2'}-t_{1'})$ over which the overlap region sweeps past the sensor or the time $(t_{4'}-t_{3'})$ between the leading and trailing zones increases in proportion to the greater distance of the receiver from the path of a sensor 6, thereby signalling the computer to advance the walking prop to reduce this difference in duration to zero.

Figure 5:
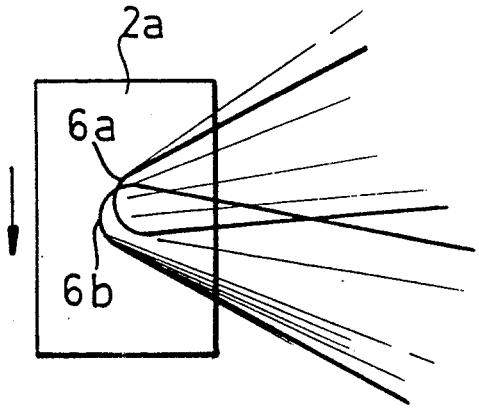
FIG. 5 is a plan view showing the two emitters at common location on the mining machine.

In FIG. 5 we have shown a mining region 2*a* in which the two emitters 6*a* and 6*b* are provided at the same location on the mining machine.

We claim:

1. A mining apparatus for the mining of a mineral face, comprising:

a mining machine displaceable back and forth along said face for mining mineral matter therefrom, thereby advancing said face;

a conveyor device positioned to receive mined mineral matter dislodged from said face by said mining machine for removing said mineral matter;

an array of walking props extending along said face and advanceable as said face is advanced, said mining machine being provided with two signal emitters trained toward said array and each emitting a diverging beam of electromagnetic radiation with at least one characteristic different from that of the other of said beams so that with respect to travel of said mining machine, one of said beams exclusively forms a leading zone, the other of said beams exclusively forms a trailing zone and said beams are superimposed in an overlapping region;

at least one signal receiver responsive to said electromagnetic radiation from both of said signal emitters on each of said walking props; and control means connected to the signal receivers of said walking props and responsive to the different characteristics of said beams for controlling advance of said walking props to enable said walking props to follow advance of said face.

2. The apparatus defined in claim 1 wherein said control means controls advance of said walking props in response to the different characteristics of said beams in said leading and trailing zones and by determining said overlapping region in which said beams are superimposed.

3. The apparatus defined in claim 1 wherein said emitters are disposed on said mining machine at substantially the same location.

4. The apparatus defined in claim 1 wherein the signal emitters are disposed on said mining machine with a spacing apart in a direction of displacement of said mining machine.

5. The apparatus defined in claim 1 wherein said overlapping region has a width at said signal receiver along said face and in a direction of displacement of said mining machine substantially equal to a length of said mining machine in said direction.

6. The apparatus defined in claim 1 wherein said signal emitters emit light as said electromagnetic radiation and said signal receivers are responsive to light.

7. The apparatus defined in claim 6 wherein said light is in an infrared range of the electromagnetic spectrum.

8. The apparatus defined in claim 1 wherein said characteristic includes frequency of said electromagnetic radiation.

9. The apparatus defined in claim 1 wherein said characteristic includes amplitude of said electromagnetic radiation.

10. The apparatus defined in claim 1 wherein said characteristic includes pulsing of said electromagnetic radiation.

11. The apparatus defined in claim 1, further comprising means for spraying said receivers with water for removing contaminants therefrom.

12. The apparatus defined in claim 1, further comprising means for spraying said emitters with water for removing contaminants therefrom.

13. The apparatus defined in claim 12, further comprising means for spraying said receivers with water for removing contaminants therefrom.

14. The apparatus defined in claim 13 wherein said signal emitters emit light as said electromagnetic radiation and said signal receivers are responsive to light.

15. The apparatus defined in claim 14 wherein said light is in an infrared range of the electromagnetic spectrum.

16. The apparatus defined in claim 1 wherein said control means controls advance of said walking props in response to the different characteristics of said beams in said leading and trailing zones and by determining said overlapping region in which said beams are superimposed, the signal emitters being disposed on said mining machine with a spacing apart in a direction of displacement of said mining machine.

17. The apparatus defined in claim 16 wherein said overlapping region has a width at said signal receiver along said face and in a direction of displacement of said mining machine substantially equal to a length of said mining machine in said direction.

18. The apparatus defined in claim 17 wherein said characteristic includes at least one of the frequency, amplitude and pulsing of said electromagnetic radiation.

* * * * *